United States Patent [19]

Miyasaka

[11] Patent Number: 4,607,836

[45] Date of Patent: Aug. 26, 1986

[54] COPYING MACHINE

[75] Inventor: Eiji Miyasaka, Hikoneshi, Japan

[73] Assignee: Dainippon Screen Mfg. Co., Ltd., Kyotoshi, Japan

[21] Appl. No.: 775,801

[22] Filed: Sep. 13, 1985

[30] Foreign Application Priority Data

Nov. 1, 1984 [JP] Japan ..... 59-167347[U]

[51] Int. Cl.[4] ..... B65H 5/06

[52] U.S. Cl. ..... 271/272; 226/181; 226/188; 355/14 SH

[58] Field of Search ..... 271/84, 314, 267, 272, 271/273, 274; 355/14 SH; 226/181, 188

[56] References Cited

U.S. PATENT DOCUMENTS 4,236,808 12/1980 Tusso ..... 355/14 SH 4,354,759 10/1982 Bujese ..... 355/14 SH

*Primary Examiner*—Richard A. Schacher

*Attorney, Agent, or Firm*—Brumbaugh, Graves, Donohue & Raymond

[57] ABSTRACT

A copying machine of reproducing the images in the original on a sheet, the copying machine comprising a motor for driving an endless belt running on a plurality of pulleys; an original carrier secured to the endless belt so that the original carrier reciprocally moves in a fixed range in accordance with the movement of the endless belt; a sheet feeding device having a pair of feed rollers adapted to feed the sheet therebetween frictionally, and a driving roller kept in contact with one of the feed rollers so that friction drive is imparted thereto, the driving roller having an input pulley on which the endless belt runs, thereby ensuring that the amount of movement of the original carrier is transmitted to the feed rollers through the driving roller; and the driving roller and the input pulley being made to have the same diameter with a material having the same coefficient of expansion.

2 Claims, 4 Drawing Figures

COPYING MACHINE

BACKGROUND OF THE INVENTION

1. Field of the Invention

The present invention relates generally to a copying machine, and more particularly, a copying machine including an improved sheet feeding device which allows the sheet to be fed synchronously with the speed of the original carrier. Herein, the sheet means any material on which the images (i.e. letters and/or pictures) in the original can be reproduced or copied.

2. Description of the Prior Art

In order to explain the background of the invention in detail, reference will be made to FIGS. 3 and 4 which illustrates a typical example disclosed in Japanese Patent Publication (unexamined) No. 59(1984)-48343.

Referring to FIGS. 3 and 4 the copying machine includes a motor M having a speed reducer, an original carrier 101 for carrying an original 102, an endless belt 103 running on a plurality of pulleys, wherein the original carrier 101 is fastened to the endless belt 103 by means Of a suitable fastener 104 so as to ensure their unitary movement, and a pair of feed rollers 105 and 105*a* adapted to feed the sheet 106 therebetween by friction. The images in the original 102 are reproduced on the sheet 106. The feed roller 105 have a diameter equal to that of an input pulley 105*b* of the feed roller 105, so as to enable them to rotate synchronously at the same circumferential speed.

The optical system includes a light source 107 for giving light to the original 102, a lens 108 and a mirror reflector 109. There are provided a roller 110 for stretching the sheet 106, and a cutter 111 for cutting the sheet 106 after the images on the original are reproduced thereon.

The driving motor M is reversibly rotatable, and when it is rotated in a clockwise direction, the original carrier 101 is moved in the direction (B) indicated by the arrow. When the original 102 has been scanned through a slit (not shown), the motor M is rotated in a counter-clockwise direction, thereby causing the original carrier 101 to move oppositely to the direction (B) until it returns to its starting position. When the original carrier is returning, the rollers 105 and 110 are prevented against their reverse rotation in the known manner, for example, by means of a one-way clutch.

The feed roller 105 is made of rubber so that it is prevented from slipping on the sheet 106 and the input pulley 105*b* is made of metal.

Metal and rubber have different coefficients of expansion, and when the feed roller 105 and the input pulley 105*b* are subjected to a rising temperature, their diametrical lengths become unequal due to their different coefficient of expansion. As a result, different circumferential speeds results. This causes a poor reproduction of the images in the original.

The inventor has investigated the cause, and ascertained that it is entirely due to the different coefficient of expansion of the rubber and metal constituting the feed roller 105 and input pulley 105*b*. As is well known, the ambient temperature around the copying machine tends to rise partly due to the heat emitted by the working machine, and also to the climatic factor. It is therefore unavoidable for the feed rollers 105 and input pulley 105*b* to be subjected to a rising temperature. As a result of the different circumferential speeds, the synchronism between the movements of the original carrier 101 and the sheet 106 is lost.

The following facts have been demonstrated by experiments:

When the temperature rises from 10° C. to 35° C., a shortage of 1.1 mm per 300 mm is caused on the length of the sheet 106 to be fed. This reduces the resolving power to about 7.5 lines/mm against 10 lines/mm in a normal state, where the scanning speed is in full synchronism with the feeding speed of the sheet. Particularly in the case of a copying machine for producing a direct plate used in the photomechanical process the resulting poor quality is fatal.

OBJECTS AND SUMMARY OF THE INVENTION

The present invention aims at solving the problems pointed out above, and has for its object to provide a copying machine which constantly secures sharp reproduction of images from the original regardless of any thermal conditions.

Another object of the present invention is to provide a copying machine which has a sheet feeding device of simplified construction, thereby reducing the production cost.

Other objects and advantages of the present invention will become more apparent from the following description when taken in conjunction with the accompanying drawings which show, for the purpose of illustration only, one embodiment in accordance with the present invention.

According to the present invention, there is provided a copying machine of reproducing the images in the original on a sheet, the copying machine comprising a motor for driving an endless belt running on a plurality of pulleys; an original carrier secured to the endless belt so that the original carrier reciprocally moves in a fixed range in accordance with the movement of the endless belt; a sheet feeding device having a pair of feed rollers adapted to feed the sheet therebetween frictionally, and a driving roller kept in contact with one of the feed rollers so that friction drive is imparted thereto, the driving roller having an input pulley on which the endless belt run, thereby ensuring that the amount of movement of the original carrier is transmitted to the feed rollers through the driving roller; and the driving roller and the input pulley being made to have the same diameter with a material having the same coefficient of expansion.

DETAILED DESCRIPTION OF THE PREFERRED EMBODIMENT

Figure 1:
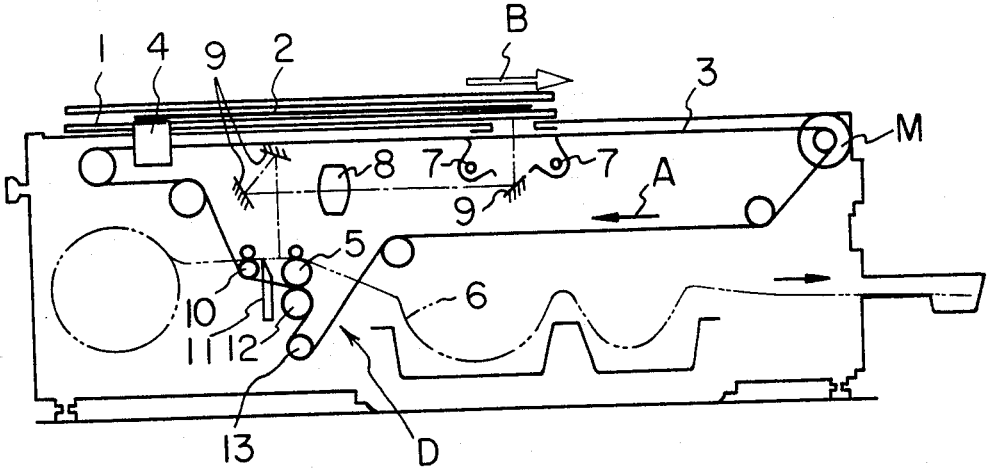
FIG. 1 is a schematic cross-sectional view showing a copying machine of a direct-plate type embodying the present invention.

The copying machine includes an endless belt 3 running on an output pulley of a motor (M), and a plurality of pulleys, the belt 3 advancing in the direction indicated by the arrow (A). An original carrier 1 is secured to the belt 3 through a fixing member 4. In accordance with the movement of the belt 3 the original carrier 1 reciprocally moves; when the belt 3 is rotated in the arrow (A) direction, the original carrier 1 moves in the arrow (B) direction. There is provided an optical system which includes a source of light 7, a lens 8 and a mirror reflector 9. The optical system is intended to pass light through the images in the original 1 to an exposing section through which a sheet 6 passes. The images are reproduced on the sheet 6. Such a system, however, is well known in the art. A further detailed description will be omitted for simplicity.

The copying machine of the present invention is characterized by a uniquely constructed sheet feeding device (D), which will be hereinafter described in detail:

The sheet feeding device (D) includes a pair of feed rollers 5 and 5*a* for imparting friction drive to a sheet 6, such as a film or a photosetting resin sheet, a driving roller 12*a* for rotating the roller 5 by surfacial friction, and an input pulley 12*b* secured to a shaft 12*c* of the driving roller 12*a*. There is provided an endless belt 3 running on the pulley 12*b* and pulleys 10*b*, 13. The rollers 5 and 5*a* are made of rubber so as to impart friction drive to the sheet effectively. The driving roller 12*a* and the input pulley 12*b* are made of metal, such as steel, which has the same coefficient of expansion. In addition, the driving roller 12*a* and the input pulley 12*b* have substantially an equal diameter, wherein the "substantially an equal diameter" means that the running speed of the belt 3 and the circumferential speed of the driving roller 12*a* are equal.

Figure 2:
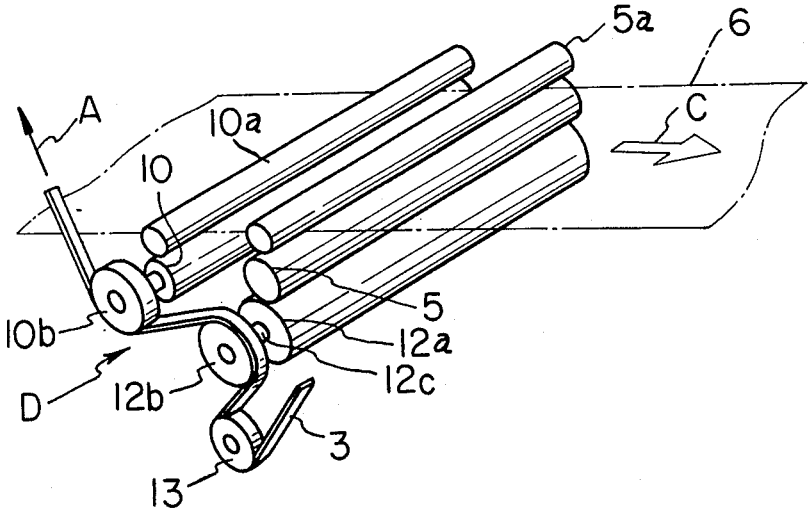
FIG. 2 is a perspective view showing a main part of the copying machine of FIG. 1.
Figure 3:
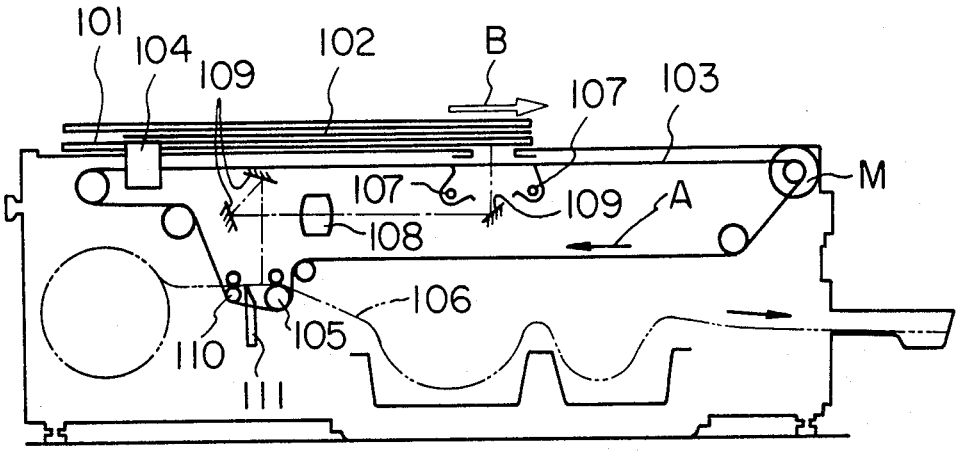
FIG. 3 is a schematic cross-sectional view showing a prior art copying machine.
Figure 4:
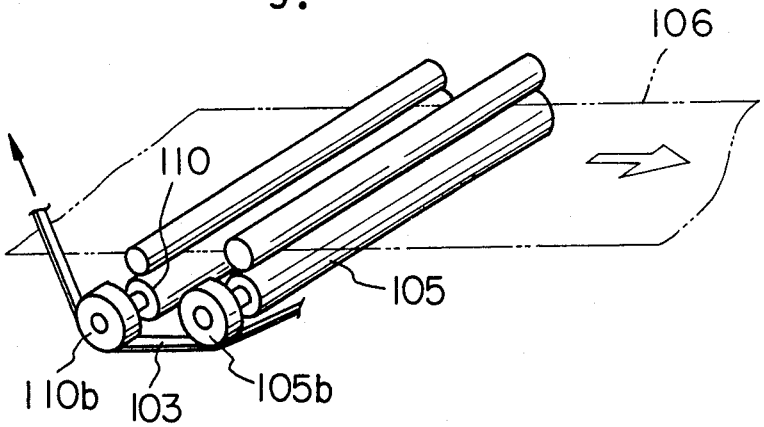
FIG. 4 is a perspective view showing a main part of the copying machine of FIG. 3.

As shown in FIG. 2, there are provided a further pair of rollers 10, 10*a*, which are intended to stretch the sheet 6 under pressure. The roller 10 is connected to the pulley 10*b*. The pulley 13 is a tension pulley.

The motor (M) is reversibly rotated; when it is rotated in the clockwise direction, the belt 3 is rotated in the arrow (A) direction, thereby causing the original carrier 1 to advance in the arrow (B) direction. When the motor is rotated in the counter-clockwise direction, the belt 3 and the original carrier 1 are moved in the opposite directions, during which the original carrier 1 returns to its starting position.

Preferably, the pulleys 10*b* and 12*b* are provided with one-way clutches (not shown), whereby when the original carrier 1 returns to its starting position in accordance with the reverse rotation of the motor (M) the rollers 10*a* and 12*a* are prevented from rotating.

In operation the motor (M) is switched on to rotate in the clockwise direction. The belt 3 is rotated in the arrow (A) direction, thereby causing the original carrier 1 to advance in the arrow (B) direction. The amount of movement of the original carrier 1 is detected in terms of that of the belt 3, and transmitted to the input pulley 12*b* of the sheet feeding device (D). In this way the rotation of the input pulley 12*b* is transmitted to the feed roller 5 through the driving roller 12*a*, thereby moving the sheet 6 in the arrow (C) direction. In the course of movement the images in the original 1 are reproduced on the sheet 6.

In the illustrated embodiment the input pulley 12*b* is connected to the shaft 12*c* of the driving roller 12*a*, so as to obtain full-scale copies. However, the present invention is not limited to this embodiment. For example, the ratio of rotation of the driving roller 12*a* is made variable to the input pulley 12*b*, thereby obtaining desired copying magnifications. Under the arrangement mentioned above the rotating ratio of the input pulley 12*b* to the driving roller 12*a* is kept constant regardless of thermal changes, thereby enabling the running speed of the original carrier 1 to the feeding speed of the sheet 6 to be equal to each other. Thus the synchronism therebetween is constantly secured.

As evident from the foregoing description, the driving roller is placed in contact with one of the feed rollers so that friction drive is imparted thereto, and so that the amount of movement of the original carrier is transmitted to the feed roller through their contacting surfaces. In addition, the driving roller and the input pulley are made to have the same diameter, with the use of a material having the same coefficient of expansion. This ensures a constant synchronism between the movements of the original and sheet, thereby obtaining a sharp reproduction of the images on the sheet from the original even if the driving roller and input pulley are subjected to a rising temperature, at which their diameters expands at an equal rate. Even if any unequalness occurs in the expansion under heat, there is no problem because the amount of movement of the original is transmitted to the feed roller so that the rotation of the feed rollers, that is, the amount of movement of the sheet, is regulated accordingly.

What is claimed is:

1. A copying machine of reproducing the images in the original on a sheet, the copying machine comprising:

a motor for driving an endless belt running on a plurality of pulleys;

an original carrier secured to the endless belt so that the original carrier reciprocally moves in a fixed range in accordance with the movement of the endless belt; and a sheet feeding device having a pair of feed rollers adapted to feed the sheet therebetween frictionally, and a driving roller kept in contact with one of the feed rollers so that friction drive is imparted thereto, the driving roller having an input pulley on which the endless belt runs, thereby ensuring that the amount of movement of the original carrier is transmitted to the feed rollers through the driving roller; and the driving roller and the input pulley being made to have the same diameter with a material having the same coefficient of expansion.

2. A copying machine as defined in claim 1, wherein the driving roller and the input pulley are connected to each other by means of a shaft axially secured to the driving roller.

* * * * *